US008348183B2

(12) United States Patent
Mertens et al.

(10) Patent No.: US 8,348,183 B2
(45) Date of Patent: Jan. 8, 2013

(54) PULVERIZER AND CORRESPONDING METHOD FOR PREPARING A BIOLOGICAL SAMPLE FOR PROCESSING

(75) Inventors: Dennis Mertens, Hilden (DE); Thomas Voit, Hilden (DE)

(73) Assignee: Qiagen GmbH, Hilden (DE)

( * ) Notice: Subject to any disclaimer, the term of this patent is extended or adjusted under 35 U.S.C. 154(b) by 483 days.

(21) Appl. No.: 12/594,479

(22) PCT Filed: Apr. 2, 2008

(86) PCT No.: PCT/EP2008/053896

§ 371 (c)(1),
(2), (4) Date: Feb. 1, 2010

(87) PCT Pub. No.: WO2008/122550

PCT Pub. Date: Oct. 16, 2008

(65) Prior Publication Data

US 2010/0137567 A1 Jun. 3, 2010

(30) Foreign Application Priority Data

Apr. 4, 2007 (DE) ..... 10 2007 016 221

(51) Int. Cl.
*B02C 19/00* (2006.01)

(52) U.S. Cl. ..... 241/2; 241/23; 241/DIG. 37

(58) Field of Classification Search ..... 241/2, DIG. 37, 241/179, 23, 65

See application file for complete search history.

(56) References Cited

U.S. PATENT DOCUMENTS

| | | | | |
|---|---|---|---|---|
| 3,172,546 | A * | 3/1965 | Schreiner | 241/23 |
| 3,785,575 | A * | 1/1974 | Langmaack et al. | 241/33 |
| 4,509,695 | A * | 4/1985 | Bessman | 241/2 |
| 6,235,501 | B1 | 5/2001 | Gautsch et al. | |
| 2003/0072576 | A1 | 4/2003 | Rodriguez | |
| 2004/0115720 | A1 | 6/2004 | McWilliams et al. | |
| 2004/0144874 | A1 | 7/2004 | Moskowitz | |
| 2005/0089859 | A1 | 4/2005 | Singer et al. | |
| 2005/0178726 | A1 | 8/2005 | Belly et al. | |
| 2006/0138263 | A1 | 6/2006 | Thornton et al. | |

FOREIGN PATENT DOCUMENTS

| | | |
|---|---|---|
| JP | 2002066366 | 3/2002 |
| JP | 2006051505 | 2/2006 |
| WO | 2004082837 | 9/2004 |

OTHER PUBLICATIONS

International Search Report for PCT/EP2008/053896 dated Oct. 2, 2008 (10 pages).

* cited by examiner

*Primary Examiner* — Mark Rosenbaum
(74) *Attorney, Agent, or Firm* — Baker, Donelson, Bearman, Caldwell & Berkowitz, PC

(57) ABSTRACT

The invention relates, for example, to methods for preparing a plant or animal sample for processing, i.e. for example for the isolation of nucleic acids or proteins from the sample, as well as to a pulverizer.

15 Claims, 2 Drawing Sheets

PULVERIZER AND CORRESPONDING METHOD FOR PREPARING A BIOLOGICAL SAMPLE FOR PROCESSING

CROSS REFERENCE TO RELATED APPLICATIONS

This application is a §371 National Stage Application of PCT/EP2008/053896 filed Apr. 2, 2008, which claims priority to German Application 10 2007 016 221.0 filed Apr. 4, 2007.

BACKGROUND OF THE INVENTION

1. Field of the Invention

The invention relates to a method for preparing a plant or animal sample for processing, i.e. for example for the isolation of nucleic acids or proteins from the sample, as well as to a pulverizer. Such preparations and tests are performed in a laboratory by a laboratory technician according to standardized processing instructions. A so-called protocol is a part of such processing instructions. An example fur such a protocol for isolating plasmid DNA from *E. coli* is apparent from document DE 101 53 957 A1.

2. Description of Related Art

In order to process a sample in the desired manner, i.e. isolate for example the nucleic acids or proteins, so-called "kits", such as the "ULTRACLEAN Tissue DNA Isolation Kit" by Qiagen (www.Qiagen.com), are commercially available depending on the sample and the desired result. Prior to processing a sample using such a kit in accordance with a predefined protocol, the sample has to be prepared in a suitable manner.

Such typical preparations known from the prior art are being described below.

For example, an organ is removed from a laboratory animal such as a rat. The selection of the organ of the animal depends on the objective.

The removed tissue of the animal is washed in a wash buffer solution such as in PBS (Phosphate Buffered Saline containing the following: $Na_2HPO_4$ (dried), $NaH_2PO_4$ (dried), NaCl and distilled water). By means of the washing process, the tissue of the removed part is provided in a blood-free state and is freed from undesired components.

Then, the removed tissue is cooled in liquid nitrogen, to stop cellular activities, among other things. Otherwise, the desired information would not be obtained in the desired quality after processing. In the process, tissue having a body temperature of, for example, 37° C. is typically submerged in liquid nitrogen. Bubbles will develop. The tissue is withdrawn from the liquid nitrogen only when the formation of bubbles ceases. The tissue is then stored at −80° C. using, for example, dry ice.

If the cooling step in liquid nitrogen is to be avoided, then the removed tissue is alternatively preserved chemically subsequent to the washing, using stabilizing reagents such as RNALATER®. RNALATER® is a viscous liquid which was developed by the company Ambion (www.ambion.com) for preserving fresh tissues. The preservative effect is primarily based on all enzymes being inactivated in the tissue due to water removal and on cellular activities being stopped. The viscous liquid has to diffuse quickly into all cells of the tissue. Therefore, the size of the pieces of tissues is to be limited to a side length of half a centimeter at most. Subsequent to the chemical treatment, the tissue thus treated is also cooled at −80° C. in order thus to store it until processing.

Typically, 10 to 100 mg of tissue is required for processing in order to be able to perform the desired test, isolation or the like. Prior to processing, the required amount of animal tissue is now cut off using a scalpel, for example.

The cut sample, that is, the cut tissue, is now disrupted, which means that the cell walls must be opened. This can be done mechanically, chemically or enzymatically. Mechanical disruption is carried out, for example, using a "TISSUERUPTER®" by the company Qiagen, known from the TISSUERUPTER® Handbook, July 2006, by Qiagen. In this case, a rotating blade disintegrates the cell walls of the tissue at 35,000 revolutions per minute. As a rule, mechanical disruptions are being carried out in a buffer in order to avoid damage to the contents, such as nucleic acids.

A mechanical disruption carried out in the presence of a buffer, that is, a chemical substance, is known from document EP 1577011 A2.

The preparation of samples in a cryogenic mill is also known (see for example http://www.laborpraxis.de/fachartikel/lp_fachartikel_nh__2384859.html, Mar. 12, 2007). In this mill, the sample is ground at the temperature of liquid nitrogen. The sample remains deep-frozen during the entire grinding process without coming into contact with the nitrogen. This technically quite complex method can be carried out in the case of such samples in which the above-mentioned method fails, for example in the case of very hard materials, such as bone, or of collagen-containing materials, such as skin. If a bone is to be prepared, putting it into a vessel filled with liquid nitrogen and crushing it using a metal rod is also known. The bone is subsequently available in a powdered form.

If histological tests are to be carried out with a microscope, then a sample is first blocked in paraffin and then cut into thin layers of tissue using a microtome.

If plant samples are to be processed, cutting to size with a scalpel is only possible in the case of soft materials, such as leaves, soft beans etc. In the case of dried or frozen plant samples, they are cooled in liquid nitrogen and ground using a pestle in a mortar cooled with liquid nitrogen.

The German patent specification 738 286 teaches freezing and grinding cells together with a dispersion liquid in order thus to disintegrate the cells.

A crushing/mixing device for foodstuffs such as spices is disclosed in each of the documents DE 602005001256 T2 and WO 2004/082837 A1. The device comprises a hollow body with a ball placed therein with which foodstuffs are to be crushed. Documents US 2004/0144874 A1, JP 2006051505 A, JP 2002-066 366 A and JP 03-186 360 A disclose other examples for ball mills and comparable devices.

SUMMARY OF THE INVENTION

A preparation of the samples in the above-mentioned manner pursues the aim of obtaining as good as a sought-for result as possible subsequent to processing. Accordingly, it is the object of the invention to provide a preparation of a sample which makes improved sought-for results subsequent to processing possible.

A solution of the object comprises the features of claim 1. Other solutions comprise the features of the independent claims, which are also directed to a method. A device for carrying out the method comprises the features of the last independent claim. Advantageous embodiments become apparent from the dependent claims.

DETAILED DESCRIPTION OF A PREFERRED EMBODIMENT

Figure 1:
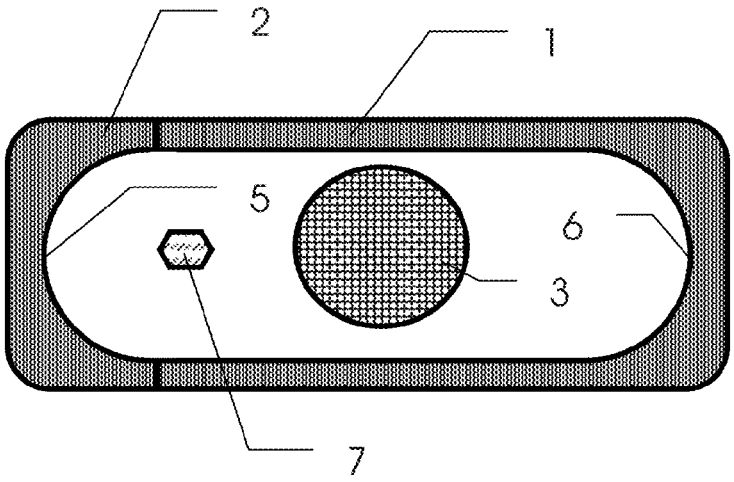
FIG. 1 shows a sectional view of a container 1 onto which a cap 2 can be screwed. A ball 3, which has a smaller diameter as compared with the diameter of the container 1, is located in the container 1. The diameter of the container is in the range of a few centimeters. The interior of the container 1 is cylindrical. In the sealed state, the ends 5 and 6 of the container are semi-spherically shaped. By shaking the container 1 appropriately, the ball 3 on the inside is moved back and forth and impacts on the ends 5 and 6. The container 1, the cap 2 and the ball 3 consist of metal, namely of stainless steel.

The teaching according to the claims works both for plant as well as for animal or human tissue, both for stabilized as well as for fresh samples of plants or tissues.

In order to achieve the object, a sample in one embodiment is first washed as described above and treated with, for example, liquid nitrogen or stored in RNALATER®. A sealable container preferably consisting of metal, or consisting of plastics and provided with a metal inlay, and a movable body located in the container are cooled, namely to a temperature distinctly below 0° C. The container consisting of plastics is a shell for the inlay. An inlay is a body that is produced separately from the shell. A distinction must be made to a double-walled container as it is known, for example, from document U.S. Pat. No. 6,235,501 B1, FIG. 10, which does not comprise an inlay within the meaning of the present invention, because the two walls known therefrom are integrally connected with each other.

The temperature to which the container is cooled should be at least −50° C. Preferably, a temperature of approx. −80° C., for example of from −70° C. to −90° C. is to be chosen, because it is significantly further away from 0° C. In addition, −80° C. or −70° C. to −90° C. can be provided in a cost-effective manner using dry ice. It was found that particularly good results can be obtained by cooling down to approx. −80° C. Temperatures lower than −80° C. are possible to a certain degree. However, attention should be paid to the fact that the container must not be cooled off too much. For example, the temperature of liquid nitrogen, that is −196° C., has proven too low to obtain good results.

The body located in the container serves the purpose of crushing, by a shaking motion of the container, a deep-frozen sample located therein. The interior of the container and the movable body located therein are dimensioned and designed in accordance with this purpose. A cylindrical interior with hollow-sphere-shaped ends is particularly suitable. In that case, the moveable body is a ball or a rod having spherical ends. The diameter of the ball or of the bolt is smaller than the diameter of the interior in order thus to ensure mobility. The moveable body consists of a hard, preferably heavy material such as metal in order to be able to crush the sample.

The biological sample, a cooled heart of a rat, for example, is preferably put into the container whole, without prior disintegration of the sample, in order thus to obtain good results. In particular, a sample that is at least −50° C. cold is put into the container. Then, the container is shaken, in particular for 10 to 30 seconds, in particular by hand, so that the moveable body is tossed back and forth. The sample thus crushed is then removed and the desired quantity is processed in accordance with a protocol, using a kit. Apart from the sample and one or more moveable bodies, there are basically no other substances in the container, in particular no cooling agent, such as liquid nitrogen or, for example, buffer solutions. They would only deteriorate the desired result.

Surprisingly, it was found that better results are obtained with this form of sample preparation than compared with the sample preparations known from the prior art, even though no great technical effort is being made and handling is simple. The technical effort is not great because the container with the moveably body located therein is only cooled in dry ice down to a temperature of, for example, −80° C. The cooled container can then be removed by hand, which can easily be protected sufficiently from the cold with gloves, the sample can be introduced, and the container can be sealed. It is then shaken for not even a minute, and the sample can be removed and, for example, be stored cooled in another container for the time being. Alternatively, the sample is not removed and stored in another container, but directly in the container containing the moveable body. In that case, it thus serves both as a disruption container and a storage container. The desired sample quantity for processing can be made available accurately and simply. In addition, a homogeneous tissue distribution is achieved in the process. Even stabilized tissue, leaves and seeds of plants can be prepared for further processing in this way. However, this method is not suitable for skin and bones and comparably hard or viscous samples.

Since the treatment in the cooled, sealed container does not require a lot of time, it is not necessary to interrupt the shaking process and cool the container again down to suitable low temperatures in the interim. This applies particularly if the container consists of metal and has walls of sufficient thickness. A wall of a few millimeters thickness is already enough. Moreover, it was found, surprisingly, that a disruption, for example in a TISSUERUPTER®, can be dispensed with. The sample thus prepared can therefore be processed immediately, and with particularly good final results.

Since the sample is present in powder form, it advantageously has a particularly large surface area on which subsequently used chemicals can act. A desired quantity of powder can be particularly simply provided for subsequent steps, for example by weighing or even by correspondingly dimensioned measuring containers such as a measuring spoon.

The invention is explained in more detail below with reference to exemplary embodiments.

FIG. 1 shows a sectional view of a container 1 onto which a cap 2 can be screwed. A ball 3, which has a smaller diameter as compared with the diameter of the container 1, is located in the container 1. The diameter of the container is in the range of a few centimeters. The interior of the container 1 is cylindrical. In the sealed state, the ends 5 and 6 of the container are semi-spherically shaped. By shaking the container 1 appropriately, the ball 3 on the inside is moved back and forth and impacts on the ends 5 and 6.

The container 1, the cap 2 and the ball 3 consist of metal, namely of stainless steel.

The container is first cooled in dry ice at −80° C.

A sample 7 is taken from an animal. The sample is washed and submerged in nitrogen until there is no formation of bubbles anymore, or it is stored in RNALATER® for 24 h, for example. The sample can then be stored at first in dry ice at minus 80° C. In the case of a plant, dried plant tissue, such as seeds, is cooled on dry ice in the container 1. Fresh plant material, such as leaves, is first cooled down to −80° C.

When the container 1 has been cooled down to the desired temperature, it is removed by hand. Expediently, the hand is protected from the cold with a cotton glove and a glove consisting of latex. The sample 7 is introduced into the container 1, in which the ball 3 is also located, with tweezers. The cap 2 is subsequently screwed onto the container 1, which is thereby sealed firmly. Now, the container 1 is shaken back and forth by hand, so that the ball 3 alternately impacts the two ends 5 and 6. The sample 7 is thus disintegrated. This process ends after 20 to 30 seconds. A flowable powder is thus produced which can at first be stored further in the container 1. The cap 2 is screwed off immediately or subsequent to storage and the crushed sample is removed. A desired quantity can now be made available, for example, by weighing.

The liver of a rat was removed and washed in PBS. The liver was then stored in RNALATER® for 24 hours. The liver of the rat was then stored at −80° C. until further use.

The liver was crushed for 20 seconds in the cooled, sealed container as described above. Using a funnel, the crushed sample was filled into a Falcon tube and at first stored further in dry ice at −80° C.

10 mg of the sample in the Falcon tube were finally weighed out with a scale. In the process, care was taken that the sample did not thaw.

180 μl of an aqueous solution containing 100 mM SDS; 100 mM EDTA; 50 mM Tris; 100 mM NaCl (BUFFER 1) and 20 μl ProtK were filled into a 2 ml reaction vessel, and the weighed-out quantity of the sample, that is 10 mg, was added under vortexing. This prevents clumping of the sample, which prevents DNEASY® or RNEASY® columns used in connection with a corresponding protocol or kit from clogging.

The DNEASY® protocol by Qiagen used comprises the following steps. 10 mg of tissue are incubated with 180 μl BUFFER 1+20 μl proteinase K at 56° C. for one hour in a rocking platform. 4 μl RNase A are then added with a pipette and incubated at room temperature for 2 minutes. 200 μl AL (lysis buffer) are then added with a pipette and incubated in a rocking platform at 70° C. for 10 minutes. In the further process, 200 μl ethanol (100%) are added with a pipette and mixed by slight inverting. This is the point at which the DNA can be recognized as a "cloud". This is a sign for the sensitivity of the method since it shows that the molecule is hardly damaged and is present in a high-molecular form. In order to increase column efficiency, the obtained solution is mixed three times by drawing it up in a pipette. The entire solution is then pipetted into a DNEASY® column and centrifuged for 1 minute at 8,000 rpm. The corresponding nucleic acid is now bound to the column material. The supernatant is discarded and the column is now washed for 1 minute with 500 μl wash buffer AW 1 at 8,000 revolutions per minute. This step was additionally applied again, even though it is not recommended by the protocol. The column is then washed for 3 minutes with 500 μl Buffer AW 2 at 14,000 revolutions per minute as described in the protocol. The supernatant is again discarded. In addition, the optional step of drying for 1 minute at 14,000 revolutions per minute described in the protocol is applied. Finally, 200 μl RNase-free water are pipetted into the center of the column and incubated for 1 minute at room temperature, in order then to be centrifuged for 1 minute at 8,000 revolutions per minute (rpm). This eluate is analyzed with a spectrometer. This serves for determining the concentration and the degree of purity. Finally, an agarose gel is prepared for the qualitative and quantitative DNA analysis. On it, the quality of the DNA, the degree of degradation, the size of the molecule as well as its amount can be determined.

Figure 2:
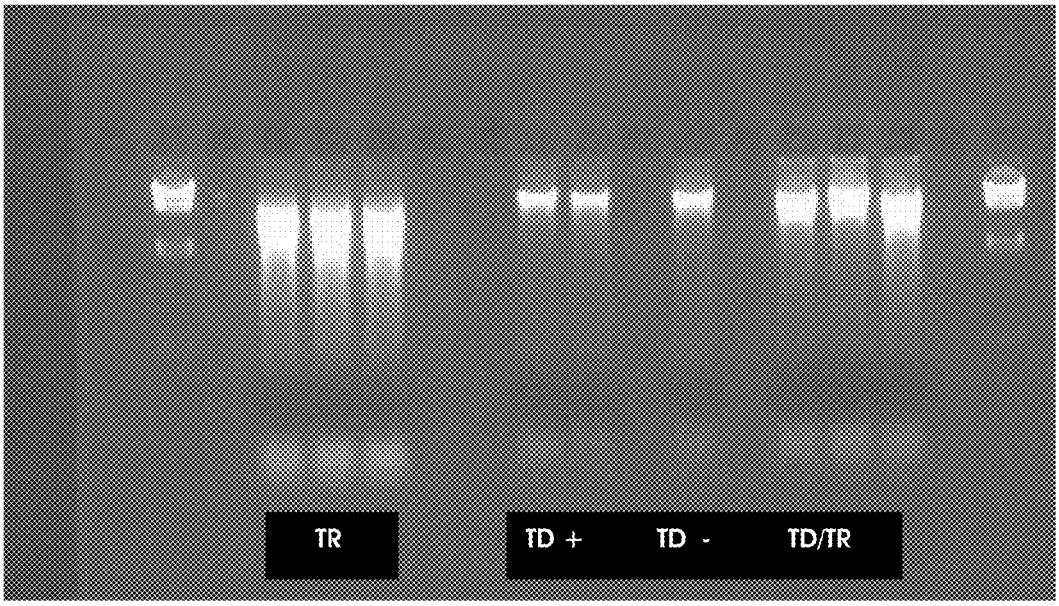
FIG. 2 shows photographs of DNA agarose gels used as described below in order to determine the quantity and the quality of the DNA. The result in which a rat's liver was at first pre-treated in accordance with the prior art in the way mentioned in the introduction, that is, washed and stored in RNALATER® at first, is shown above "TR". On the right next to that, the result obtained by the method according to the invention is shown above "TD+". On the right next to that, the result obtained by the method according to the invention, in which no mixing with a pipette was carried out in order thus to improve column efficiency, is shown above "TD−". On the right next to that, the result in which the sample was first prepared according to the invention, is shown above "TD/TR".

The results thus obtained are illustrated in FIG. 2 and compared with comparative examples. The result in which a rat's liver was at first pre-treated in accordance with the prior art in the way mentioned in the introduction, that is, washed and stored in RNALATER® at first, is shown above "TR". A desired sample quantity of 10 mg was then separated and disrupted in a TISSUERUPTER®.

On the right next to that, the result obtained by the method according to the invention is shown above "TD+". In order better to be able to exploit the column efficiency of the DNEASY® column in the context of processing, the solution processed according to the DNEASY® protocol was mixed by drawing it up and then discharging it three times with a pipette after 200 μl ethanol (100%) had been added. The high-molecular DNA is thereby prepared such that is can bind to the DNEASY® column.

On the right next to that, the result obtained by the method according to the invention, in which no mixing with a pipette was carried out in order thus to improve column efficiency, is shown above "TD−".

On the right next to that, the result in which the sample was first prepared according to the invention, is shown above "TD/TR". Finally, however, the crushed sample was further disrupted for 3 seconds in a TISSUERUPTOR®. It can clearly be seen by the smudged edges that an intensification of the degradation occurs already after 3 seconds.

The light upper areas in FIG. 2 characterize the genomic DNA. The light area above TR does not extend as high as those above TD+, TD− or TD/TR. The higher the light area extends, the more high-molecular the obtained DNA is, and the better, therefore, the result obtained is.

The light area above TR obtained in accordance with the prior art, is smudged and transitions into a light-grey area. This is a sign of the DNA having been degraded, that is, damaged. Such damage could be avoided by the method according to the invention according to TD+ and TD−.

FIG. 2 shows photographs of DNA agarose gels used as described above in order to determine the quantity and the quality of the DNA. For this purpose, a 1% gel is poured. To this end, 1 g agarose powder (long-chained carbohydrate molecules that can polymerize) is weighed out and dissolved in 100 ml (1×) TAE buffer and heated up in the microwave. After 5 μl ethidium bromide is added to the solution obtained, it is mixed by shaking the flask and poured into a mold. Combs are now clamped into the hot solution, which, when the solution cools off and polymerizes, leave impressions in the gel that later form slots into which the sample, mixed with 5 μl loading dye, is pipetted. In order to be able to achieve a result later under ultraviolet light, a marker is additionally applied onto the gel for later scale comparison. After a voltage has been applied, the DNA disperses based on its different weight and charge, i.e. small degraded fragments move faster in the gel than high-molecular DNA.

The DNA obtained in accordance with the method according to the invention can be seen with the naked eye in the form of a cloud.

25 mg of "fresh" rat heart was tested within the context of another experiment. "Fresh" means that it was not treated with the stabilizing reagent, but was first deep-frozen in liquid nitrogen. Using the method according to the invention, twice the concentration of RNA was obtained as compared with the method known from the prior art described in the introduction.

In this experiment, the same pulverization method was used as in the above-described experiment. The heart of the rat was removed and cooled using liquid nitrogen until the formation of bubbles ceased. The heart was then stored on dry ice (−80° C.). Shortly before processing, container 1 was cooled on dry ice and filled with the frozen whole heart and shaken by hand for 20 seconds. The powder was then stored in the container in order to make time for getting the materials for the RNEASY® Fibrous Tissue Mini protocol. This did not present a problem, because the container was the disruption and storage container at the same time. For further processing according to the above mentioned protocol, 300 μl of an aqueous solution containing 3.5 M GTC; 28 mM $Na_3$-Citrate×$2H_2O$ (RLT buffer, lysis buffer) was mixed with 3 μl β-mercaptoethanol in a 2 ml reaction container under an exhaust hood and 25 mg of the stored heart tissue powder was weighed into the reaction vessel and subsequently vortexed. Added were 590 μl RNase-free water and 10 μl ProtK (enzyme), which was mixed by pipette before it was incubated on a rocking platform for 10 minutes at 55° C. in order then to be centrifuged for 3 minutes at room temperature at 10,000×g. The supernatant was then pipetted into a new 2 ml reaction vessel and 0.5 times the volume of 96%-100% ethanol was added by pipette and mixed by means of the pipette. At first 700 μl of the solution was then pipetted into a RNEASY® column and centrifuged for 15 seconds at 10,000 revolutions per minute. Because the column only has a capacity of 700 μl, this step was repeated for the remaining solution, so that the entire sample was poured over the column. The supernatant after centrifuging was discarded. The column was then washed for 15 seconds with 350 μl buffer RW1 at 8,000 revolutions per minute and the supernatant discarded. Now, 10 μl DNase I stock solution was mixed with 70 μl RDD buffer for each sample and mixed by inversion. 80 μl of this solution was then poured exactly into the center of the column and incubated for 15 minutes at room temperature. 350 μl buffer RW1 were then poured onto the column in order to wash it for 15 seconds at 8,000 g. The RNEASY® column was then transferred into a new 2 ml collection tube and filled with 500 μl RPE in order to again wash it for 15 seconds at 8,000 g. The supernatant was again discarded. The last step was repeated, with the difference that centrifuging was now done for 2 minutes at 8,000 g. The column was now once again transferred into a new 2 ml reaction vessel and dried therein for 1 minute at maximum speed. For the final step, the column was transferred into a new 2 ml reaction vessel and filled with 30 μl RNase-free water and centrifuged for 1 minute at 10,000 revolutions per minute for eluting. The eluate was then also analyzed using a spectrometer and evaluated by means of an RNA agarose gel.

Additionally, various crushing experiments were performed, among other things, in a mortar at −196° C. In the end, these tests showed that neither cooling down to −196° C., nor the use of a mortar are suitable for achieving the desired results.

Figure 3:
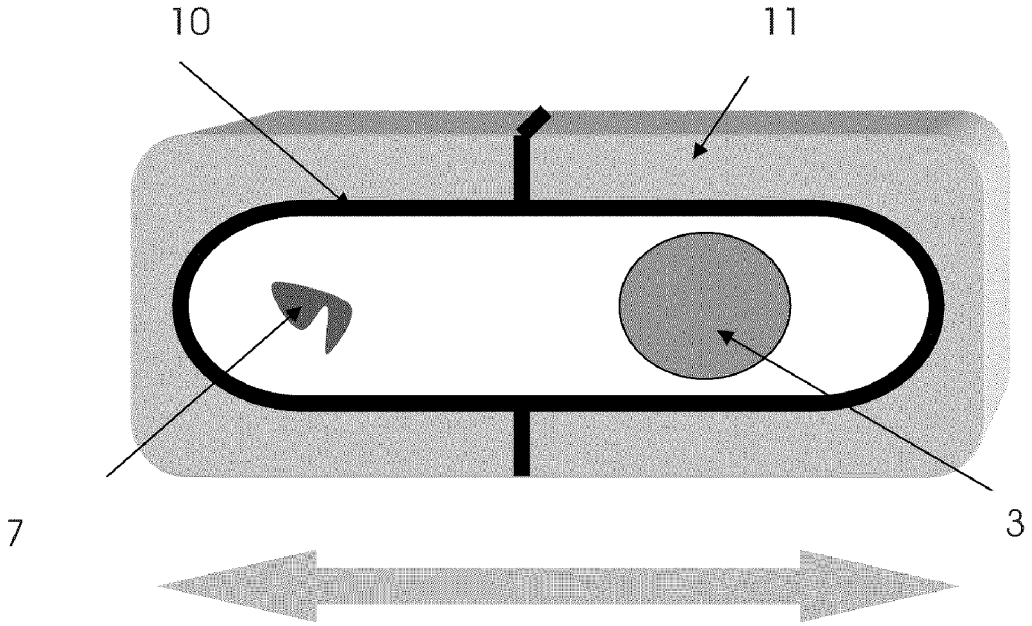
FIG. 3 shows a particularly preferred embodiment of a sealable container with which a sample is pulverized. This container is hereinafter referred to as pulverizer. It comprises an inlay 10 which preferably consists of metal for the above-mentioned reasons. The inlay 10 is enclosed by a shell 11 preferably consisting of plastics. The plastics shell primarily serves as an insulator for maintaining the low temperature during shaking. On the whole, the weight can advantageously be reduced in comparison with a pulverizer that consists entirely of metal, which facilitates handling. The double arrow underneath the pulverizer shown in FIG. 3 illustrates the preferred direction of movement for crushing the sample 7.

FIG. 3 shows a particularly preferred embodiment of a sealable container with which a sample is pulverized. This container is hereinafter referred to as pulverizer. It comprises an inlay 10 which preferably consists of metal for the above-mentioned reasons. The inlay 10 is enclosed by a shell 11 preferably consisting of plastics. The plastics shell primarily serves as an insulator for maintaining the low temperature during shaking. On the whole, the weight can advantageously be reduced in comparison with a pulverizer that consists entirely of metal, which facilitates handling. The double arrow underneath the pulverizer shown in FIG. 3 illustrates the preferred direction of movement for crushing the sample 7.

The buffers and reagents mentioned in the present application are commercially available from the company Qiagen GmbH, Hilden, Germany, unless otherwise expressly stated.

Figure 4:
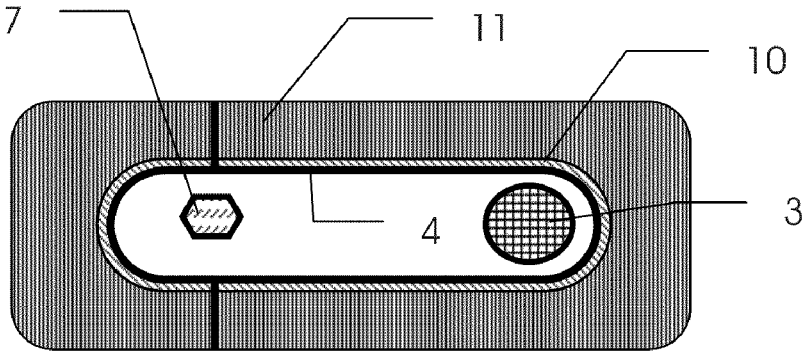
FIG. 4 shows a section through a further improved embodiment of the invention. The pulverizer includes an inner sealable container 4 consisting of plastics. The inner container consisting of plastics adjoins the inner walls of the pulverizer, which preferably consist of metal, so closely that the inner container consisting of plastics cannot be destroyed by a ball 3 or comparable means during pulverization. The inner container 4 consisting of plastics is removed after pulverization and can now serve as a storage vessel. Because the inner container consists of plastics, it can be produced very inexpensively and is therefore suitable for one-time use. In that case, this embodiment of the invention simplifies handling because the inner container can be replaced, because cleaning of the interior of the pulverizer is not required in that case, and because cross-contaminations are particularly reliably avoided.

FIG. 4 shows a section through a further improved embodiment of the invention. The pulverizer includes an inner sealable container 4 consisting of plastics. The inner container consisting of plastics adjoins the inner walls of the pulverizer, which preferably consist of metal, so closely that the inner container consisting of plastics cannot be destroyed by a ball 3 or comparable means during pulverization. The inner container 4 consisting of plastics is removed after pulverization and can now serve as a storage vessel. Because the inner container consists of plastics, it can be produced very inexpensively and is therefore suitable for one-time use. In that case, this embodiment of the invention simplifies handling because the inner container can be replaced, because cleaning of the interior of the pulverizer is not required in that case, and because cross-contaminations are particularly reliably avoided.

The cap of the inner container seals the remaining portion of the container preferably by a positive connection, or it can be screwed onto the remaining portion. A positive connection is possible because plastics can be sufficiently elastic so that, for example, an inwardly protruding collar snaps into an annular recess of the remaining container body provided for this purpose, or vice versa, when the cap is suitably pressed onto the remaining container body. Such a positive connection is to be particularly preferred because an inadvertent release of the cap is particularly reliably avoided. Furthermore, a container can be sealed faster as compared to sealing by means of a screw closure.

In one embodiment of the invention, a set comprises, apart from a pulverizer, a plurality of inner containers which preferably are visually different, for example owing to differently colored caps or different embossing. The different visual appearance can advantageously be used for marking the contents. For example, a container cap colored red can be used for marking a "heart" contained therein, and another cap, which for example is colored green, another organ, such as a lung.

An inner container serving for storing a pulverized sample in that case does not have to be marked separately, which may cause problems due to the low temperatures.

It is to be preferred that only the container caps are marked differently with regard to their visual appearance in order thus to keep storage costs low.

The inner container consisting of plastics can consist of PET, but also of PP or PE, because such plastics are capable in principle of withstanding the intended low temperatures.

In one embodiment of the invention, a set comprises, apart from a pulverizer, one or more measuring spoons in order thus to facilitate or expedite the removal of the required sample quantity from the pulverizer or from an inner container. Thus, a measuring spoon is dimensioned and allocated to certain samples in such a way that the measuring spoon is capable of accommodating a suitable quantity of the sample for further processing. Separately weighing a sample removed from the container can thus be accelerated or even dispensed with entirely.

In one embodiment of the invention, a set includes a plurality of visually marked measuring spoons allocated to different samples. A red-colored measuring spoon can be provided for removing a heart sample, for example. In particular, the marks of inner containers or parts of inner containers match the marks of measuring spoons in one embodiment of the invention. In that case, such a set also comprises a predetermined allocation of marks to samples, that is, to organs, for example. Thus, if a measuring spoon colored green, for example, is provided for the lung, then an inner container is also entirely or partially colored green. The measuring spoon is dimensioned so as to correspond to the sample "lung". In that case, the set contains appropriate allocation instructions. These may consist of a corresponding sample, such as a lung, being depicted on a corresponding container and/or the measuring spoon.

In one embodiment of the invention, a set comprises, apart from a pulverizer, a shaker apparatus for being able to carry out the disruption of a sample contained in the pulverizer automatically. One or more pulverizers can be inserted into or suitably attached to the shaker apparatus.

In one embodiment of the invention, the shaker apparatus comprises coolable accommodation facilities for accommodating pulverizers. In this embodiment in particular, the disruption does not have to be carried out immediately after the sample has been inserted, if cooling can be provided in a sufficient extent. Thus, a plurality of pulverizers can be prepared and inserted prior to a simultaneous automatic disruption of a plurality of samples.

The invention claimed is:

1. A method for disrupting a biological sample, wherein a solid biological sample having a temperature of below −50° C. is introduced into a container comprising a pulverizer cooled below −50° C. and wherein said container can be opened and sealed, and wherein a moveable body cooled below −50° C. is located in said container and said container is set in motion after the container has been sealed and crushes the biological sample, wherein the container is neither cooled during crushing, nor are cooling media nor chemical substances introduced into the container during or prior to the disruption which are still present in the container during the disruption.

2. A method disrupting a biological sample, wherein a solid biological sample having a temperature of below −50° C. is introduced into a sealable container cooled below −50° C., in which a moveable body cooled below −50° C. is located that is set in motion after the container has been sealed and crushes the biological sample, wherein the container is neither cooled during crushing, nor are cooling media nor chemical substances introduced into the container during or prior to the disruption which are still present in the container during the disruption.

3. A method according to claim 1 wherein the biological sample having a temperature in the range from −70° C. to −90° C. is introduced into a sealable container cooled to a temperature in the range from −70° C. to −90° C.

4. A method according to claim 1 wherein the biological sample is a plant sample.

5. A method according to claim 1, wherein the biological sample is animal or human tissue.

6. A method according to claim 1 wherein the moveable body is set in motion by manual shaking.

7. A method for the analysis of a biological sample, comprising the steps of disrupting the sample according to claim 1, partially or completely removing the disrupted sample, and isolating nucleic acids and/or proteins from the disrupted sample.

8. A method for preparing the processing of a plant or animal sample, wherein the sample is first washed and then stabilized, wherein the sample, subsequent to stabilization, is deep-frozen, wherein a sealable container with a moveable body located therein is deep-frozen, wherein the deep-frozen sample is introduced into the deep-frozen container with the moveable body located therein, the deep-frozen container is subsequently sealed and the deep-frozen container is shaken back and forth and a sample crushed thereby is subsequently removed.

9. A method according to claim 8, wherein the sample, subsequent to the stabilization, and/or the sealable container with a moveable body located therein is deep-frozen in dry ice.

10. A method according to claim 8, wherein the sealed, deep-frozen container is shaken back and forth for 10 to 40 seconds with the sample located therein and the moveable body located therein.

11. A method according to claim 8, wherein the container does not contain any liquid components while the sample is located in the container and/or wherein the sample is not bone and not skin.

12. A method according to claims 8, wherein a liver, a heart, leaves or plant seed are used as a sample.

13. A method according to claim 8, wherein the moveable body is a ball and the interior of the sealable container is cylindrical with hollow-sphere-shaped.

14. A method according to claim 8, wherein the crushed sample is processed subsequent to the removal of the deep-frozen, crushed sample from the sealable container.

15. A method according to claim 2, wherein the sample is introduced into an inner plastic container together with a moveable body and the inner container is inserted into the sealable container.

* * * * *